US007226246B2

(12) United States Patent
Fox

(10) Patent No.: US 7,226,246 B2
(45) Date of Patent: Jun. 5, 2007

(54) APPARATUS AND METHOD FOR BUILDING SUPPORT PIERS FROM ONE OR SUCCESSIVE LIFTS FORMED IN A SOIL MATRIX

(75) Inventor: Nathaniel S. Fox, Paradise Valley, AZ (US)

(73) Assignee: Geotechnical Reinforcement, Inc., Las Vegas, NV (US)

( * ) Notice: Subject to any disclaimer, the term of this patent is extended or adjusted under 35 U.S.C. 154(b) by 0 days.

(21) Appl. No.: 10/728,405

(22) Filed: Feb. 12, 2004

(65) Prior Publication Data

US 2004/0115011 A1 Jun. 17, 2004

Related U.S. Application Data

(63) Continuation-in-part of application No. 10/178,676, filed on Jun. 24, 2002, now Pat. No. 6,688,815, which is a continuation of application No. 09/882,151, filed on Jun. 15, 2001, now Pat. No. 6,425,713.

(60) Provisional application No. 60/513,755, filed on Oct. 23, 2003, provisional application No. 60/211,773, filed on Jun. 15, 2000.

(51) Int. Cl.
*E02D 3/02* (2006.01)
*E02D 3/12* (2006.01)

(52) U.S. Cl. ..... 405/240; 405/255; 405/271; 175/424

(58) Field of Classification Search ..... 405/231, 405/232, 248, 249, 255, 271; 52/721
See application file for complete search history.

(56) References Cited

U.S. PATENT DOCUMENTS

| | | | | |
|---|---|---|---|---|
| 977,356 A | | 11/1910 | Withrow | 405/243 |
| 1,477,567 A | * | 12/1923 | Lancaster | 405/243 |
| 2,729,067 A | | 1/1956 | Patterson | |
| 3,137,483 A | | 6/1964 | Zinkiewicz | 175/19 |
| 3,151,687 A | | 10/1964 | Sato et al. | 175/21 |
| 3,270,511 A | * | 9/1966 | Colle | 405/237 |
| 3,344,611 A | | 10/1967 | Philo | 405/240 |
| 3,420,067 A | | 1/1969 | Bjerking | 405/239 |
| 3,465,834 A | | 9/1969 | Southworth, Jr. | 544/211 |

(Continued)

FOREIGN PATENT DOCUMENTS

GB 1 392 868 5/1975

(Continued)

OTHER PUBLICATIONS

European International Search Report Dated Aug. 24, 2005.

*Primary Examiner*—Tara L. Mayo
(74) *Attorney, Agent, or Firm*—Banner & Witcoff, Ltd.

(57) ABSTRACT

An apparatus and method for forming a support pier having a single or multiple compacted aggregate lifts in a soil matrix, wherein the apparatus includes a vertical, hollow tube with a bulbous leading end or head element that is forced into the soil matrix. The hollow tube includes a mechanism for releasing aggregate from the lower head element of the tube as the tube is lifted incrementally. The same hollow tube is then utilized to compact the released aggregate. The process may be repeated to form a series of compacted lifts comprising a pier.

18 Claims, 9 Drawing Sheets

U.S. PATENT DOCUMENTS

| | | | | | |
|---|---|---|---|---|---|
| 3,772,892 | A | * | 11/1973 | Ogawa | 405/171 |
| 3,831,386 | A | * | 8/1974 | Phares et al. | 405/249 |
| 3,869,869 | A | * | 3/1975 | Pao Chen | 405/240 |
| 4,026,370 | A | | 5/1977 | Foster et al. | 175/20 |
| 4,078,619 | A | | 3/1978 | Sudnishnikov et al. | 175/19 |
| 4,091,661 | A | | 5/1978 | Handy et al. | 73/784 |
| 4,230,425 | A | | 10/1980 | Gusev et al. | |
| 4,648,746 | A | | 3/1987 | Abinett | 405/184 |
| 5,145,285 | A | | 9/1992 | Fox et al. | 405/302.4 |
| 5,152,639 | A | * | 10/1992 | Visconti | 405/240 |
| 5,249,892 | A | | 10/1993 | Fox et al. | 405/233 |
| 6,354,766 | B1 | | 3/2002 | Fox | 405/232 |
| 6,354,768 | B1 | | 3/2002 | Fox | 405/238 |
| 6,425,713 | B2 | | 7/2002 | Fox et al. | 405/243 |
| 6,540,443 | B2 | * | 4/2003 | Kato et al. | 405/232 |
| 6,881,013 | B2 | * | 4/2005 | Otsuka et al. | 405/232 |

FOREIGN PATENT DOCUMENTS

| | | | |
|---|---|---|---|
| GB | 1 406 769 | | 9/1975 |
| GB | 1 438 734 | | 6/1976 |
| GB | 1 517 250 | | 7/1978 |
| GB | 1 522 931 | | 8/1978 |
| GB | 1 527 343 | | 10/1978 |
| GB | 1530 865 | | 11/1978 |
| GB | 1 542 541 | | 3/1979 |
| GB | 1 554 019 | | 10/1979 |
| GB | 2 022 169 | | 12/1979 |
| GB | 2 022 651 | A | 12/1979 |
| GB | 1 567 343 | | 5/1980 |
| GB | 2 049 762 | A | 12/1980 |
| GB | 2 143 561 | A | 2/1985 |
| SU | 649789 | | 5/1979 |
| WO | WO 1994/023135 | | 10/1994 |
| WO | WO 97/24493 | | 7/1997 |
| WO | WO 98/13554 | | 4/1998 |
| WO | WO 99/13167 | | 3/1999 |
| WO | WO 99/50506 | | 10/1999 |
| WO | WO 00/75436 | A1 | 12/2000 |
| WO | WO 01/36753 | A1 | 5/2001 |
| WO | WO 02/35013 | A1 | 5/2002 |
| WO | WO 02/48466 | A1 | 8/2002 |
| WO | WO 03/062539 | A1 | 7/2003 |
| WO | WO 03/091503 | A1 | 11/2003 |
| WO | WO 2004/005626 | A1 | 1/2004 |
| WO | WO 2004/035938 | A2 | 4/2004 |
| WO | WO 2004/035938 | A3 | 4/2004 |

* cited by examiner

FIG.1
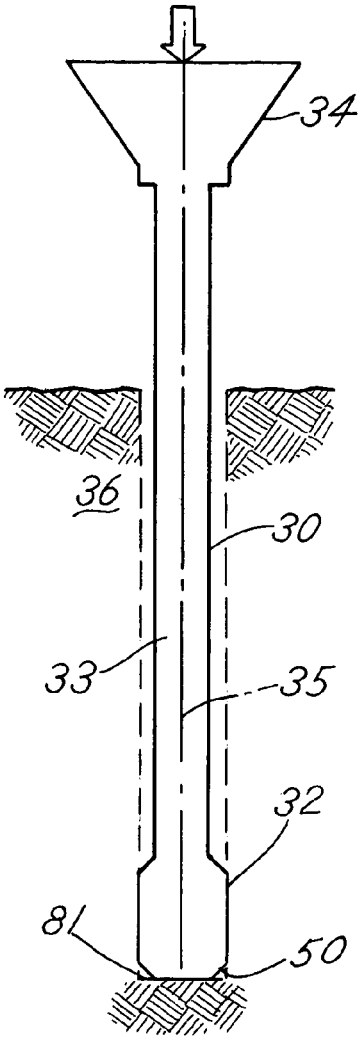
FIG.2
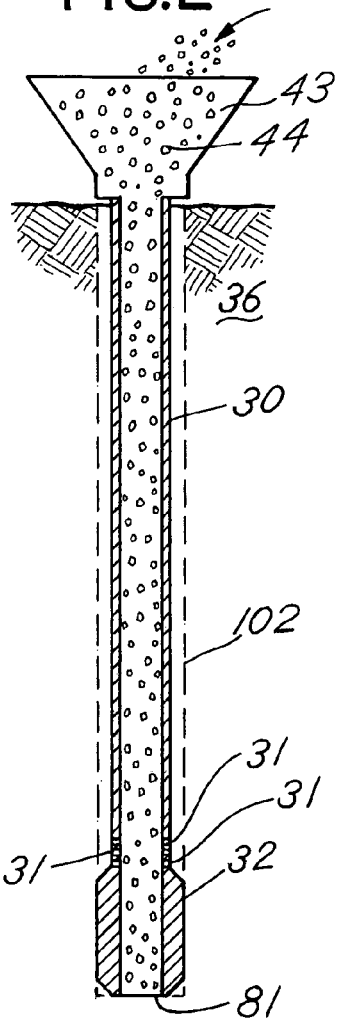
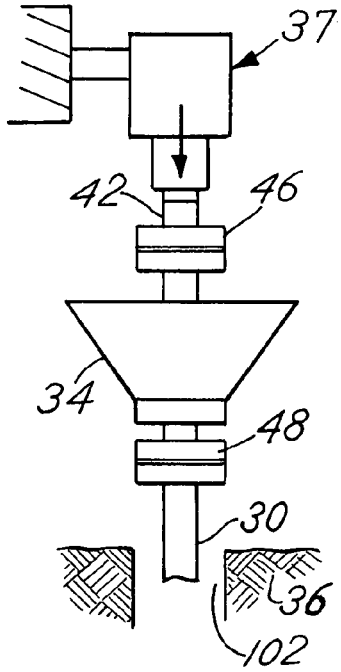
FIG.3
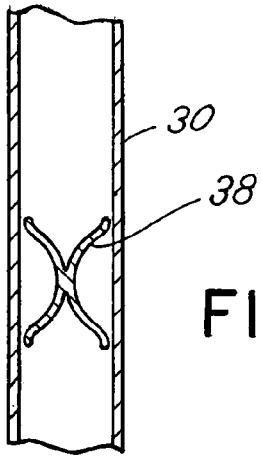
FIG.4

FIG.3A
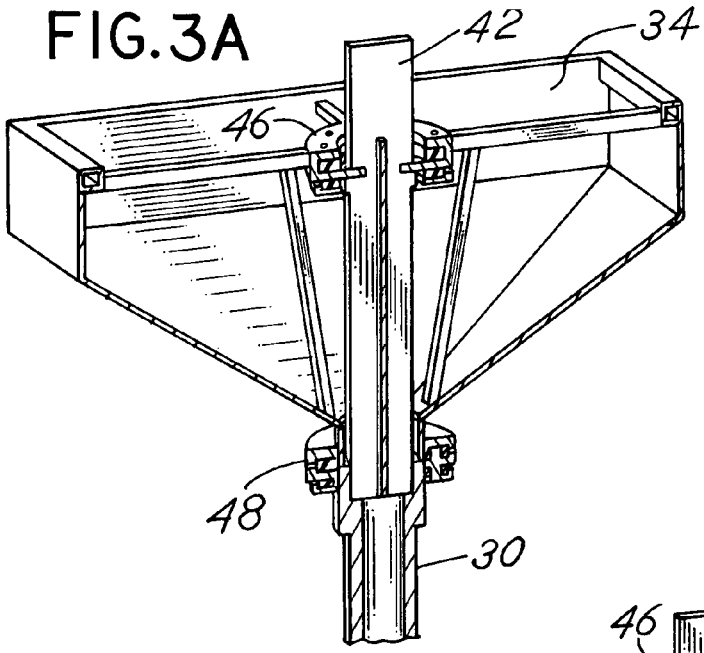
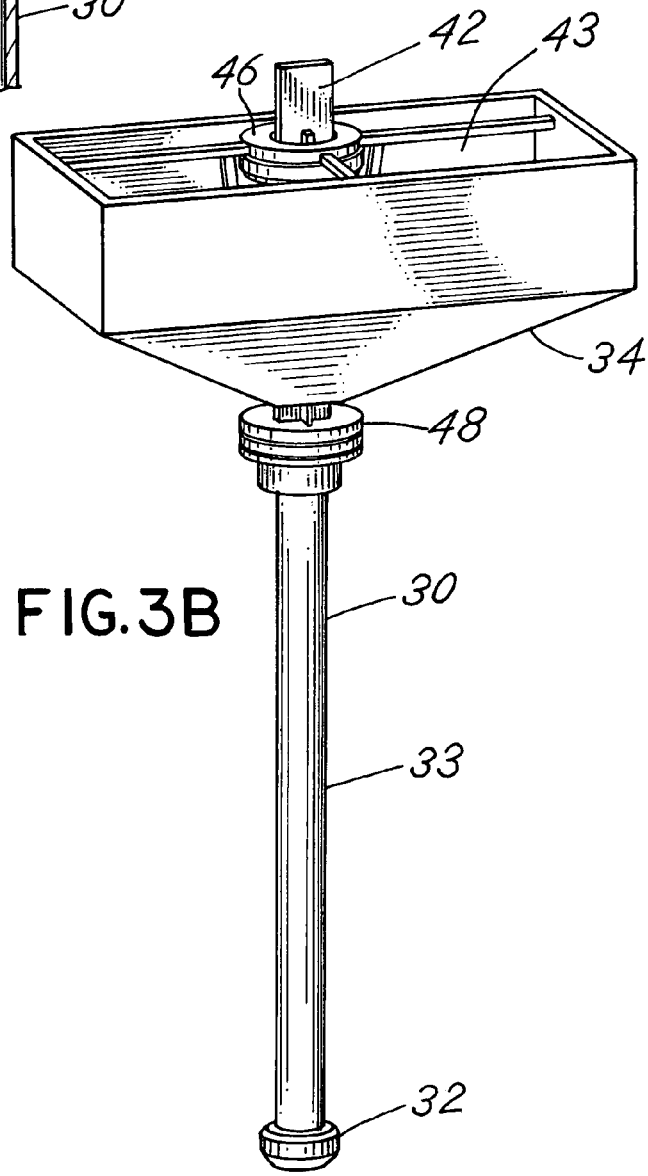
FIG.3B

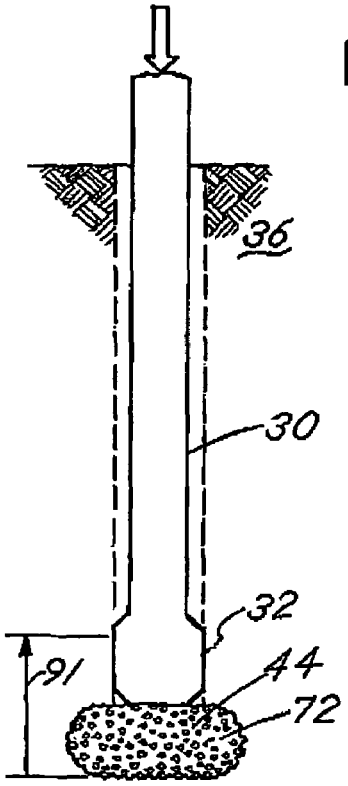
FIG.9
FIG.12
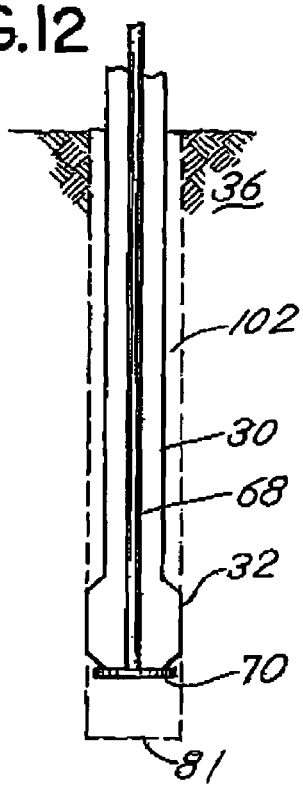
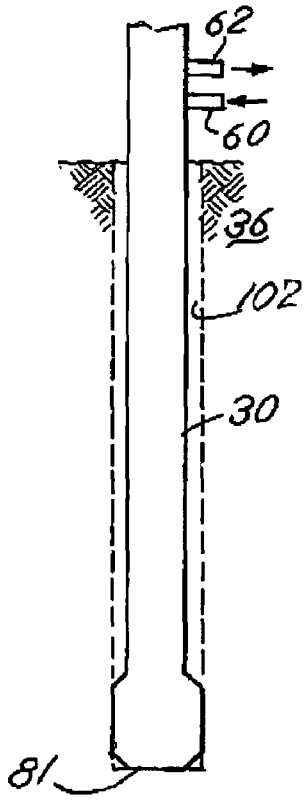
FIG.13
FIG.10
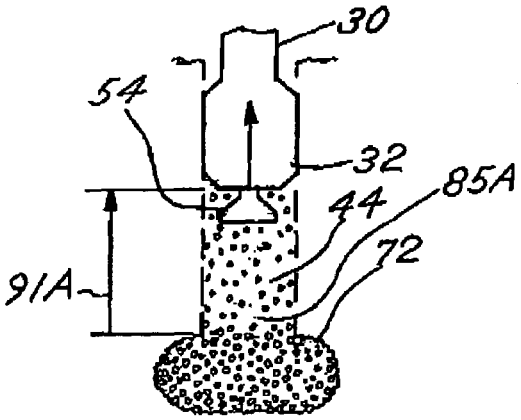
FIG. 11
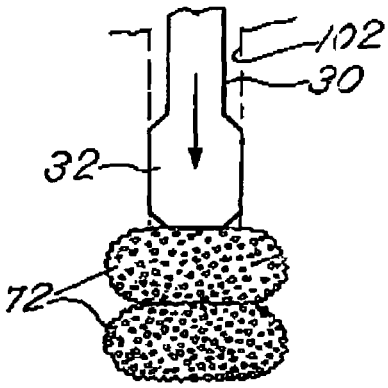

FIG.14
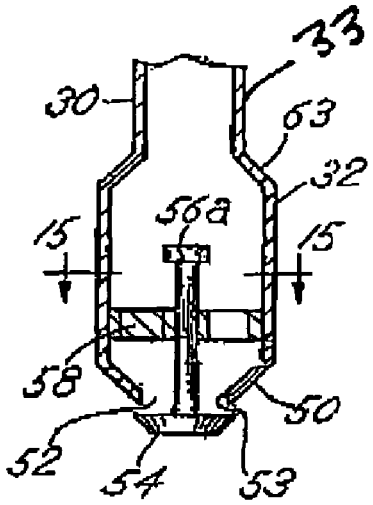
FIG.16
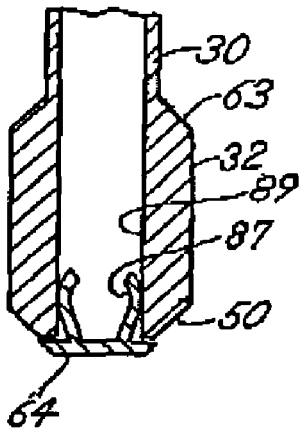
FIG.17
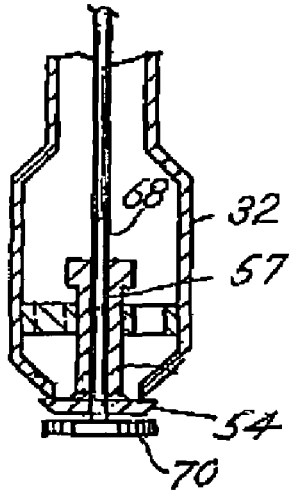
FIG.18
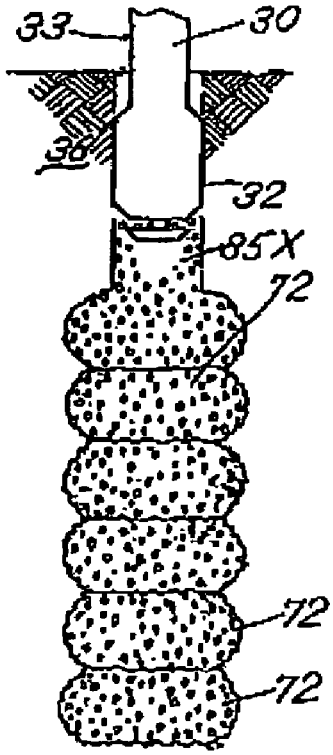
FIG. 19
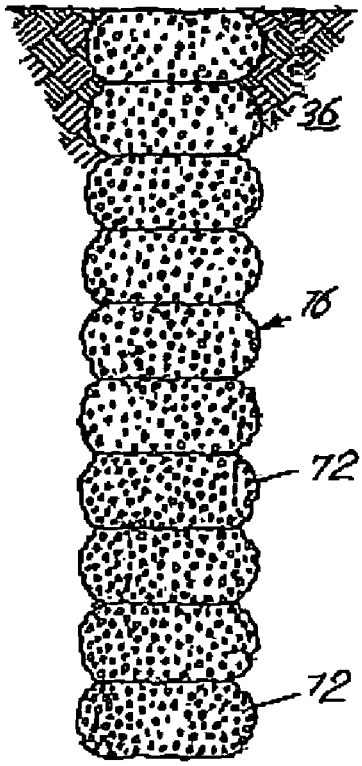
FIG.15
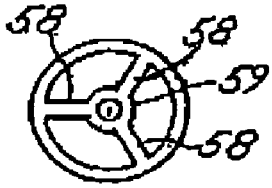
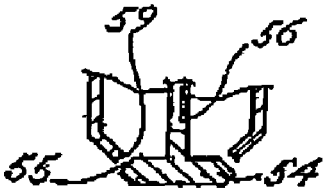
FIG.15A

APPARATUS AND METHOD FOR BUILDING SUPPORT PIERS FROM ONE OR SUCCESSIVE LIFTS FORMED IN A SOIL MATRIX

CROSS REFERENCE TO RELATED APPLICATION

The present application is a continuation-in-part of Ser. No. 10/178,676 filed Jun. 24, 2002, now U.S. Pat. No. 6,688,815 issued Feb. 10, 2004 entitled "Lateral Displacement Pier and Method of Installing the Same", which is a continuation of parent application Ser. No. 09/882,151 filed Jun. 15, 2001, now U.S. Pat. No. 6,425,713 B2 issued Jul. 30, 2002, entitled "Lateral Displacement Pier, and Apparatus and Method for Forming the Same", which in turn is based upon a provisional application Ser. No. 60/211,773, filed Jun. 15, 2000 entitled "Displaced Aggregate Pier", and also derived from and incorporating provisional application Ser. No. 60/513,755 filed Oct. 23, 2003 entitled "Apparatus and Method for Building Support Piers From Successive Lifts Formed in a Soil Matrix" all of which are incorporated herewith by reference and for which priority is claimed.

BACKGROUND OF THE INVENTION

In a principal aspect, the present invention relates to an apparatus and a method for constructing a support pier comprised of one or more compacted lifts of aggregate material. The apparatus enables formation or construction of a single or multi-lift pier within a soil matrix while simultaneously reinforcing the soil adjacent the pier. The apparatus thus forms a cavity in the soil matrix by forcing a hollow tube device into the soil matrix followed by raising the tube device, injecting aggregate through the tube device into the cavity section beneath the raised tube device and then driving the tube device downward to compact the aggregate material while simultaneously forcing the aggregate material laterally into the soil matrix.

In U.S. Pat. No. 5,249,892, incorporated herewith by reference, a method and apparatus are disclosed for constructing short aggregate piers in situ. The process includes drilling a cavity in a soil matrix and then introducing and compacting successive layers or lifts of aggregate material in the cavity to form a pier that can provide support for a structure. Such piers are made by first drilling a hole or cavity in a soil matrix, then removing the drill, then placing a relatively small, discrete layer of aggregate in the cavity, and then ramming or tamping the layer of aggregate in the cavity with a mechanical tamper. The mechanical tamper is typically removed after each layer is compacted, and additional aggregate is then placed in the cavity for forming the next compacted layer or lift. The lifts or layers of aggregate, which are compacted during the pier forming process, typically have a diameter of 2 to 3 feet and a vertical rise of about 12 inches.

This apparatus and process produce a stiff and effective stabilizing column or pier useful for the support of a structure. However this method of pier construction has a limitation in terms of the depth at which the pier forming process can be accomplished economically, and the speed with which the process can be conducted. Another limitation is that in certain types of soils, especially sand soils, cave-ins occur during the cavity drilling or forming process and may require the use of a temporary casing such as a steel pipe casing. Use of a temporary steel casing significantly slows down pier production and therefore increases the cost of producing piers. Thus, typically the process described in U.S. Pat. No. 5,249,892 is limited to forming piers in limited types of soil at depths no greater than approximately 25 feet.

As a result, there has developed a need for a pier construction process and associated mechanical apparatus which can be successfully and economically utilized to form or construct piers at greater depths, at greater speeds of installation, and in sands or other soils that are unstable when drilled, without the need for a temporary casing, yet having the attributes and benefits associated with the short aggregate pier method, apparatus, and construction disclosed in U.S. Pat. No. 5,249,892, as well as additional benefits.

SUMMARY OF THE INVENTION

Briefly, the present invention comprises a method for installation of a pier formed from one or more layers or formed lifts of aggregate material, with or without additives, and includes the steps of positioning or pushing or forcing an elongate hollow tube having a special shaped bottom head element and unique tube configuration into a soil matrix, filling the hollow tube including the bottom head element with an aggregate material, releasing a predetermined volume of aggregate material from the bottom head element as the hollow tube is lifted a predetermined incremental distance in the cavity formed in the soil matrix, and then imparting an axial, static vector force and optional dynamic vector forces onto the hollow tube and its special bottom head element to transfer energy via the lower end of the hollow tube to the top of the lift of released aggregate material thereby compacting the lift of aggregate material and also forcing the aggregate material laterally or transaxially into the sidewalls of the cavity. Lifting of the hollow tube having the special bottom head element followed by pushing down with an applied axial or vertical static vector force and optional dynamic vector forces impacts the aggregate material which is not shielded by the hollow tube from the sidewalls of the cavity at the time of impaction, thereby densifying and compacting the aggregate material as well as forcing the material laterally outward into the soil matrix due to lateral forces on the aggregate material and the soil matrix. The compacted aggregate material thus defines a "lift" which generally has a lateral dimension or diameter greater than that of the cavity formed by the hollow tube and head element resulting in a pier construction formed of one or more lifts.

The aggregate material is released from the special bottom head element of the hollow tube as the special bottom head element is lifted, preferably in predetermined incremental steps, first above the bottom of the cavity and then above the top portion of each of the successive pier lifts that has been formed in the cavity and the adjacent soil matrix by the process. The aggregate material released from the hollow tube is compacted by the compacting forces delivered by the hollow tube and special bottom head element after the hollow tube has been lifted to expose a portion of the cavity while releasing aggregate material into that exposed portion. The hollow tube is next forced downward to compact the aggregate and to push it laterally into the soil matrix. The aggregate material is thereby compacted in predetermined, sequential increments, or lifts. The process is continuously repeated along the length or depth of the cavity with the result that an aggregate pier or column of separately compacted lifts or layers is formed within the soil matrix. A pier having a length of forty (40) feet or more can be constructed in this manner in a relatively short period of time without removal of the hollow tube from the soil. The resulting pier also generally has a cross sectional dimension greater than that of the hollow tube.

A number of types of aggregate material can be utilized in the practice of the process including crushed stone of many types from quarries, or re-cycled, crushed concrete. Additives may include water, dry cement, or grout such as water-cement sand-grout, fly-ash, hydrated lime or quicklime, or any other additive may be utilized which may improve the load capacity or engineering characteristics of the formed pier. Combinations of these materials may also be utilized in the process.

The hollow tube with the special bottom head element may be positioned within the soil matrix by pushing and/or vertically vibrating or vertically ramming the hollow tube having the leading end, special bottom head element into the soil with an applied axial or vertical vector static force and optionally, with accompanying dynamic vector forces. The soil, which is displaced by initial forcing, pushing and/or vibrating the hollow tube with the special bottom head element, is generally moved and compacted laterally into the preexisting soil matrix as well as being compacted downwardly. If a hard or dense layer of soil is encountered, the hard or dense layer may be penetrated by drilling or predrilling that layer to form a cavity or passage into which the hollow tube and special bottom head element may be placed and driven.

The hollow tube is typically constructed from a uniform diameter tube with a bulbous bottom head element and may include an internal valve mechanism near or within the bottom head element or a valve mechanism at the lower end of the head element. The hollow tube is generally cylindrical with a constant, uniform, lesser diameter along an upper section of the tube. The bulbous or larger external diameter lower end of the hollow tube (i.e. bottom head element) is integral with the hollow tube or may be separately formed and attached to the lower end of a lesser diameter hollow tube. That is, the bottom head element is also generally cylindrical, typically has a greater external diameter or external cross sectional profile than the remainder of the hollow tube and is concentric about the center line axis of the hollow tube. The lead end of the bottom head element is shaped to facilitate penetration into the soil matrix and to transmit desired vector forces to the surrounding soil as well as to the aggregate material released from the hollow tube. The transition from the lesser external diameter hollow tube section to the bottom head element may comprise a frustoconical shape. Similarly, the bottom of the head element may employ a frustoconical or conical shape to facilitate soil penetration and compaction. The leading end of the bottom head element may include a sacrificial cap member which penetrates the soil matrix upon initial placement of the hollow tube into the soil matrix, while preventing soil from entering the hollow tube. The sacrificial cap is then released from the end of the hollow tube to reveal an end passage as the hollow tube is first lifted so that aggregate material may flow into the cavity which results from lifting the hollow tube.

Alternatively, or in addition, the leading end bottom head element may include an outlet passage with a mechanical valve that is closed during initial penetration of the soil matrix by the hollow tube and bottom head element, but which may be opened during lifting to release aggregate material. Other types of leading end valve mechanisms and shapes may be utilized to facilitate initial matrix soil penetration, permit release of aggregate material when the hollow tube is lifted and to transmit vector forces in combination with the leading end or bottom head element to compact the successive lifts.

Further, the apparatus may include means for positioning an uplift anchor member within the formed pier as well as a tell-tale mechanism for measuring the movement of the bottom of the formed pier upon loading, such as during load testing. Such ancillary features or means are introduced through the hollow tube during formation of the pier.

Thus, it is an object of this invention to provide a hollow tube with a special design bottom head element useful to create a compacted aggregate pier, with or without additives, that extends to a greater depth and to provide an improved method for creating a pier which extends to a greater depth than typically enabled or practiced by known short aggregate pier technology.

Yet another object of the invention is to provide an improved method and apparatus for forming a pier of compacted aggregate material that does not require the use of temporary steel casing during the pier formation process, particularly in soils susceptible to caving in such as sandy soils.

Yet another object of the invention is to provide an improved method and apparatus for forming a pier of compacted aggregate material that may include a multiplicity of optional additives, including a mix of stone, addition of water, addition of dry cement, addition of cementitious grout, addition of water-cement-sand, addition of fly-ash, addition of hydrated lime or quicklime, and addition of other types of additives to improve the engineering properties of the matrix soil, of the aggregate materials and of the formed pier.

Yet a further object of the invention is to provide an aggregate material pier construction which is capable of being installed in many types of soil and which is further capable of being formed at greater depths and at greater speeds of construction than known prior aggregate pier constructions.

Another object of the invention is to provide a pier forming apparatus useful for quickly and efficiently constructing compacted multi-lift piers and/or piers comprised of as few as a single lift.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 1 is a schematic view of a hollow tube with a bottom head element being pushed, forced or driven into soil by a vertical, static vector force and optional dynamic forces;

FIG. 2 is a schematic view of a subsequent step from FIG. 1 wherein aggregate material is placed into a hopper and fed into the hollow tube;

FIG. 3 is a cross sectional view of a hopper that has double isolation dampers and may be used in combination with the hollow tube;

FIG. 3A is a sectional, isometric view of the hopper and hollow tube of FIG. 3;

FIG. 3B is an isometric view of the hopper and hollow tube of FIG. 3;

FIG. 4 is a cross sectional schematic view of a hollow tube having an internal pinch or check valve;

FIG. 9 is a schematic view wherein the hollow tube and its associated special bottom head element provide a vertical, static vector force with optional dynamic forces to move the hollow tube and bottom head element downward a predetermined distance by impacting and compacting the aggregate material released from the hollow tube and by pushing the aggregate material laterally into the soil matrix;

FIG. 10 is a schematic view of the hollow tube and its special bottom head element being lifted a predetermined distance to form a second lift;

FIG. 11 is a schematic view of the hollow tube and bottom head element operating to provide a vertical vector force to move the hollow tube and bottom head element downward a predetermined distance to form the second compacted lift on the top of a first compacted lift;

FIG. 12 is a schematic view of the hollow tube with an optional reinforcing steel rod element or tell-tale element attached to a plate for installation inside of pier;

FIG. 13 is a schematic view of the hollow tube wherein optional water or water-cement-sand grout is combined in the hollow tube with aggregate;

FIG. 14 is a vertical cross sectional view of the special bottom head element with a trap door-type bottom valve;

FIG. 15 is a cross sectional view of the bottom head element of FIG. 14 taken along the line 15-15;

FIG. 15A is a cross sectional view of a portion of an alternative bottom head element of the type depicted in FIG. 14;

FIG. 16 is a cross sectional view of the special bottom head element including a sacrificial cap at the lower end similar to FIG. 8A;

FIG. 17 is a cross sectional view of the special bottom head element with an optional uplift anchor member or tell-tale attached to a plate;

FIG. 18 is a cross sectional view of a partially formed multiple lift pier formed by the hollow tube and special bottom head element and method of the invention;

FIG. 19 is a cross sectional view of a completely formed multiple lift pier formed by hollow tube and special bottom head element and method of the invention;

DESCRIPTION OF THE PREFERRED EMBODIMENT

Figure 5:
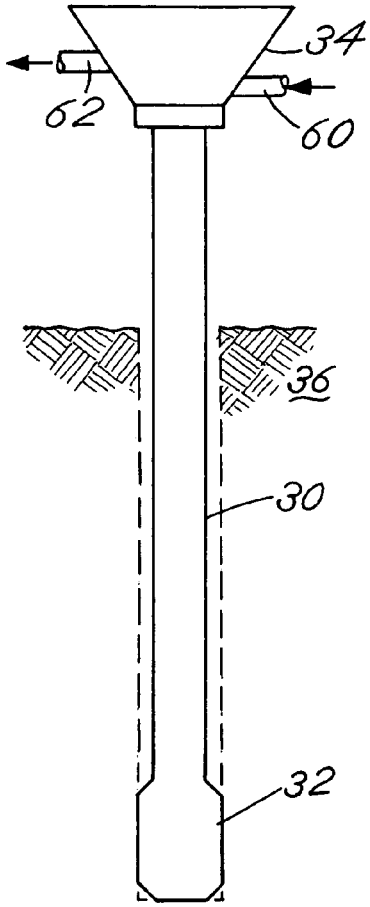
FIG. 5 is a schematic view depicting the step of optional introduction of water, cementations grout or other additive material into the hollow tube with recirculation provided to a water or grout reservoir.

General Construction:

FIGS. 1, 2, 5, 6, 7, 9, 10, 11, 12, 13, 18, 19, 20 and 23-25 illustrate the general overall construction of the pier forming device or mechanism and various as well as alternative sequential steps in the performance of the method of the invention that produce the resultant pier construction. Referring to FIG. 1, the method is applicable to placement of piers in a soil matrix which requires reinforcement for the soil to become stiffer or stronger. A wide variety of soils may require the practice of this invention including, in particular, sandy and clay soils. With the invention, it is possible to construct piers comprised of one or more lifts, utilizing aggregate materials and optionally utilizing aggregate materials with additive materials such as water-cement-sand grout, which have greater stiffness and strength than many prior art aggregate piers, which can economically be extended to or built to greater depths than many prior art piers, which can be formed without use of temporary steel casing unlike many prior art piers, and which can be installed faster than many prior art piers.

As a first step, a hollow tube or hollow shaft 30 having a longitudinal axis 35 including or with a special bottom head element 32, and an associated top end hopper 34 for aggregate, is pushed by a static, axial vector force driving apparatus 37 in FIG. 3 and optionally vertically (axially) vibrated or rammed or both, with dynamic vector forces, into a soil matrix 36. The portion of soil matrix 36, that comprises the volume of material displaced by pushing a length of the hollow tube 30 including the special bottom head element 32, is forced primarily laterally thereby compacting the adjacent soil matrix 36. As shown in FIG. 1, the hollow tube 30 may comprise a cylindrical steel tube 30 having a longitudinal axis 35 and an external diameter in the range of 6 to 14 inches, for example. In the event that a layer of hard or dense soil prevents pushing of the hollow tube 30 and special bottom head element 32 into the soil matrix 36, such hard or dense layer may be drilled or pre-drilled, and the pushing process may then continue utilizing the driving apparatus 37.

Typically, the hollow tube 30 has a uniform cylindrical external shape, although other shapes may be utilized. Though the external diameter of the hollow tube 30 is typically 6 to 14 inches, other diameters may be utilized in the practice of the invention. Also, typically, the hollow tube 30 will be extended or pushed into the soil matrix 36 to the ultimate depth of the pier, for example, up to 40 feet or more. The hollow tube 30 will normally fasten to an upper end drive extension 42 which may be gripped by a drive apparatus or mechanism 37 to push and optionally vibrate or ram, the hollow tube 30 into the soil matrix 36. The hopper 34, which contains a reservoir 43 for aggregate materials, will typically be isolated by isolation dampers 46, 48 from extension 42. The vibrating or ramming device 37 which is fastened to extension 42 may be supported from a cable or excavator arm or crane. The weight of the hopper 34, ramming or vibrating device 37 (with optional additional weight) and the hollow tube 30 may be sufficient to provide a static force vector without requiring a separate static force drive mechanism. The static force vector may optionally be augmented by a vertically vibrating and/or ramming dynamic force mechanism.

FIGS. 3, 3A and 3B illustrate a special feature preferably associated with the hopper 34. Double isolation dampers 46, 48 are affixed to the upper and lower sides of the hopper 34 to reduce the vibration buildup of the hopper 34 and provide a hopper assembly with greater structural integrity. Extension 42 is affixed to tube 30 to impart the static and dynamic forces on the tube 30. Extension 42 is isolated from hopper 34 and thus is slidable relative to dampers 46, 48.

FIG. 4 illustrates an optional feature of the hollow tube 30. A restrictor, pinch valve, check valve or other type of valve mechanism 38 may be installed within the hollow tube 30 or in the special bottom head element or lower end section 32 of the hollow tube 30 to partially or totally close off the internal passageway of the hollow tube 30 and stop or control the flow or movement of aggregate materials 44 and optional additive materials. This valve 48 may be mechanically or hydraulically opened, partially opened or closed in order to control movement of aggregate materials 44 through the hollow tube 30. It may also operate by gravity in the manner of a check valve which opens when raised and closes when lowered onto the aggregate material 44.

FIG. 14 illustrates the construction of the special bottom head element or section 32. The special bottom head element 32 is cylindrical, although other shapes may be utilized. Typically, the external diameter of the special bottom head element 32 is greater than the nominal external diameter of the upper section 33 of the hollow tube 30 and is 10 to 18 inches, although other diameters and/or cross sectional profiles may be utilized in the practice of the invention. That is, the head element 32 may have cross sectional dimensions the same as or less than that of hollow tube 30 though such configuration is generally not preferred.

FIGS. 14, 15 and 15A illustrate an embodiment of the invention having a valve mechanism incorporated in the head element 32. The head element 32 has a frustoconical bottom section or bottom portion 50 with an aggregate material 44 discharge opening 52 that opens and closes as a valve plate 54 exposes or covers the opening 52. The valve plate 54 is mounted on a rod 56 that slides in a hub 59 held in position by radial struts 58 attached to the inside passage walls of the head element 32 of the hollow tube 30. The plate 54 slides to a closed position when the hollow tube 30 is forced downward into the soil matrix 36 and slides to an open position when hollow tube 30 is raised, thus allowing aggregate material 44 to flow. The opening of valve 54 is controlled or limited by rod 56 which has a head 56*a* that limits sliding movement of rod 56. The hollow tube 30 may thus be driven to a desired depth 81 (FIG. 6) with opening 52 closed by plate 54. Then as the hollow tube 30 is raised (for example, the distance 91 in FIG. 10), the plate 54 extends downwardly due to gravity so that aggregate material 44 will flow through opening 52 into the cavity formed due to the raising of the hollow tube 30. Thereafter, the tube 30 is impacted or driven downwardly closing valve plate 54 and compacting the released material to form a compacted lift 72. In the embodiment of FIGS. 14, 15, 15A the valve plate 54 moves in response to gravity. However, rod 56 may alternatively be replaced or assisted in movement by a fluid drive, mechanical or electrical mechanism. Alternatively, as described hereinafter, the plate 54 may be replaced by a sacrificial cap 64 or by the bottom plate of an uplift anchor or a tell-tale mechanism 70 as described hereinafter. Also, the check valve 38 in FIG. 4 may be utilized in place of the valve mechanism depicted in FIGS. 14, 15, 15A.

Typically, the internal diameter of the hollow tube 30 and head element 32 are uniform or equal, though the external diameter of head element 32 is typically greater than that of hollow tube 30. Alternatively, when a valve mechanism 54 is utilized, the internal diameter of the head element 32 may be greater than the internal diameter of the hollow tube 30. Head element 32 may be integral with hollow tube 30 or formed separately and bolted or welded onto hollow tube 30. Typically, the inside diameter of the hollow tube 30 is between 6 to 10 inches and the external diameter of the head element 32 is about 10 to 18 inches. The opening diameter 53 in FIG. 14 at the extreme lower end or leading end of the head element 32 may be equal to or less than the internal diameter of the head element 32. For example, referring to FIG. 14, the head element 32 may have an internal diameter of 12 inches and the opening diameter 53 may be 6 to 10 inches, while in FIG. 16, with the sacrificial cap embodiment desoribed hereinafter, the discharge opening of head element 32 has the same diameter as the internal diameter of the head element 32 and hollow tube 30.

Also the plate or valve 54 may be configured to facilitate closure when the hollow tube 30 is pushed downward into the soil matrix 36 or against aggregate material 44 in the formed cavity. For example, the diameter of member 54 may exceed that of opening 52 as shown in FIG. 14 or the edge 55 of the valve member may be beveled as depicted in FIG. 15A to engage beveled edge 59 of opening 52. Then when applying a static or other downward force to the hollow tube 30, the valve plate 54 will be held in a closed position in opening 52.

The bulbous lower head element 32 of hollow tube 30 typically has a length in the range of one to three times its diameter or maximum lateral dimension. The head element 32 provides enhanced lateral compaction forces on the soil matrix 36 as tube 30 penetrates or is forced into the soil and thus renders easier the subsequent passage of the lesser diameter section 33 of the hollow tube 30. The frustoconical or inclined leading and trailing edges 50, 63 of the head element 32 facilitate lowering or driving penetration and lateral compaction of the soil 36 because of their profile design. The trailing inclined edge 63 in FIG. 14 facilitates the raising of the hollow tube 30 and head element 32 and lateral compaction of soil matrix 36 during the raising step of the method. Again, the shape or inclined configuration of head element 32 enables this to occur. Typically the leading and trailing edges 50, 63 form a 45°±15° angle with the longitudinal axis 35 of the hollow tube 30.

FIG. 5 illustrates another feature of the hollow tube 30. Inlet port 60 and outlet port 62 are provided at the lower portion of the hopper 34 or the upper end of hollow tube 30 to allow addition of water or of grout, such as water-cement-sand grout, as an additive to the aggregate for special pier constructions. A purpose of the outlet port 62 is to maintain the water or additive level where it will be effective to facilitate flow of aggregate and also to allow recirculation of the grout from a reservoir back into the reservoir to facilitate mixing and to keep the water head or grout head (pressure) relatively constant. The inlet port 60 and outlet port 62 may lead directly into the hopper 34 or into the hollow tube 30 (see FIG. 13), or may connect with separate channels or conduits to the head element 32. Note, grout discharge openings 31 may be provided through hollow tube 30 above head element 32 as shown in FIG. 2 to supplement discharge of grout into the annular space about hollow tube 30 and prevent cavity fill in by soil from the matrix 36.

FIGS. 8A, 8B, 8C and 16 illustrate another alternate feature of the bottom head element 32. A sacrificial cap 64 may be utilized in lieu of the bottom or lower end sliding valve 54 to protect the head element 32 from clogging when the head element 32 is pushed down through soil matrix 36. The cap 64 may be configured in any of a number of ways. For example, it may be flat, pointed or beveled. It may be arcuate. When beveled, it may form an angle of 45±25° with respect to horizontal axis 35. Cap 64 may include a number of outwardly biased legs 87 positioned to fit in the central opening 89 of the bottom head element 32 and hold cap 64 in place until hollow tube 30 is first raised and aggregate 44 caused to flow out the opening 52 into an exposed cavity section.

Figure 20:
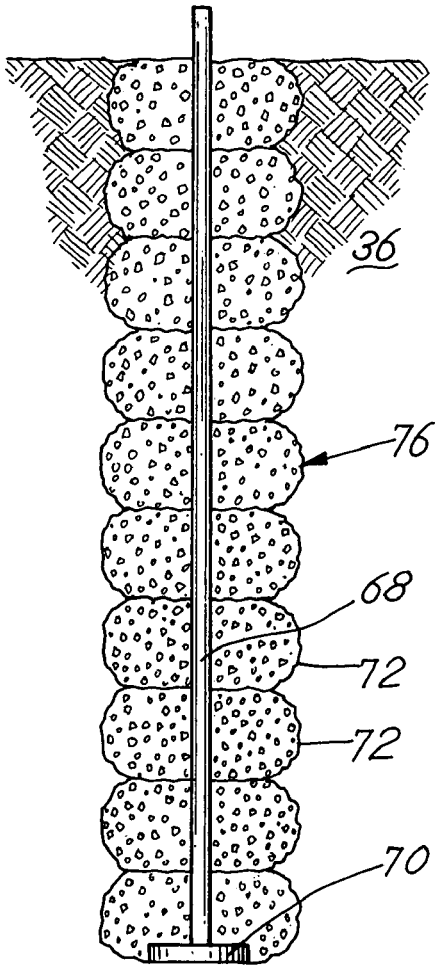
FIG. 20 is a cross sectional view of a formed, multiple lift pier with an optional reinforcing steel rod having an attached plate which enables the formed pier to comprise an uplift anchor pier or to include a tell-tale element for subsequent load testing.

FIG. 17 illustrates another alternate feature of the special bottom head element 32. The sliding plate 54 and rod 56 for support of plate 54 may include a passage or axial tube 57 that allows the placement of a reinforcing element or rod 68 attached to a bottom plate 70. The rod 68 and plate 70 will be released at the bottom of a formed cavity and used to provide an uplift anchor or a tell-tale for measuring bottom movement of a pier during a load test. The sliding rod 68 attached to a bottom plate 70 may be substituted for the sacrificial cap 64 closing the opening of the special head element 32 during pushing into the soil matrix 36, and perform as a platform for the uplift anchor or tell-tale being installed. The bottom valve plate 54 may thus be omitted or may be kept in place while the uplift anchor or tell-tale elements are being utilized. FIG. 20 illustrates the uplift anchor 68, 70 or tell-tale in place upon the forming of a pier by the invention wherein the plate or valve 54 is omitted.

Figure 6:
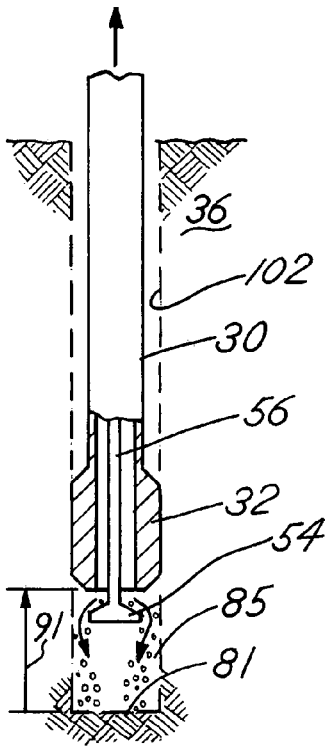
FIG. 6 is a schematic view depicting a step subsequent to the step of FIG. 2 wherein the hollow tube with its bottom head element are lifted a predetermined distance to temporarily expose a hollow cavity in the soil matrix to allow aggregate to quickly fill the exposed hollow cavity.

Method of Operation:

FIG. 1 illustrates the typical first step of the operation of the described device or apparatus. The hollow tube 30 with special head element 32 and attached upper extension 42 and connected hopper assembly 34, are pushed with a vertical or axial static vector force, typically augmented by dynamic vector forces, into the soil matrix 36 by drive apparatus 37 or by the weight of the component parts. In practice, utilizing a tube 30 with special bottom head element 32 having the dimensions and configuration described, a vector force of 5 to 20 tons applied thereto is typical throughout. FIG. 2 illustrates placing of aggregate 44 into the hopper 34 when the hollow tube 30 and attachments reach the planned depth 81 of pier into the soil matrix 36. FIG. 6 illustrates subsequent upward or lifting movement of the hollow tube 30 by a predetermined lifting distance 91, typically 24 to 48 inches to reveal a portion of cavity 102 below the lower section head element 32 in the soil matrix 36.

Figure 7:
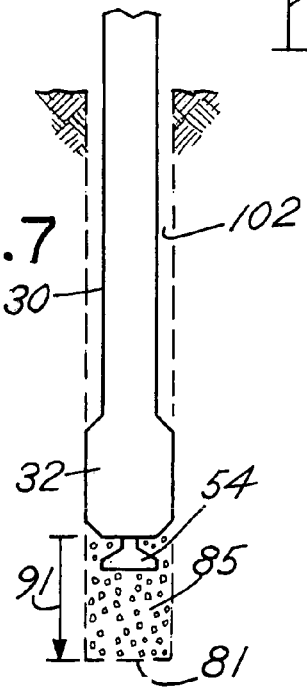
FIG. 7 is a schematic view of the process step subsequent to FIG. 6 wherein a bottom valve in the bottom of the hollow tube is opened releasing aggregate into an unshielded or hollow cavity section.
Figure 8B:
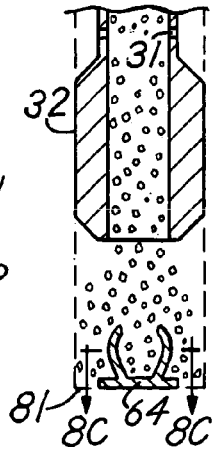
FIGS. 8A and 8B are schematic cross sectional views of an alternative to the device and step represented or illustrated in FIG. 7 wherein the bottom head element of the hollow tube includes a sacrificial cap which is released into the bottom of a formed cavity in FIG. 8B.
Figure 8A:
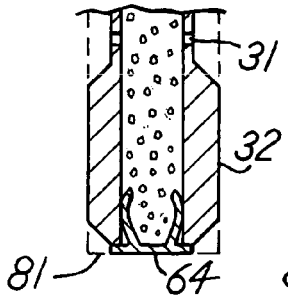
Figure 8C:
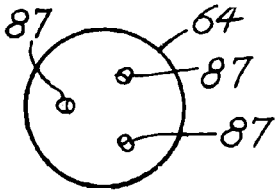
FIG. 8C is a sectional view of the sacrificial cap of FIG. 8B taken along the line 8C-8C in FIG. 8B.

FIG. 7 illustrates opening of the bottom valve 54 to allow aggregate 44 and optional additives to fill the space or portion 85 of cavity 102 below the special head element 32 while the hollow tube 30 and attachments are being raised. The valve 54 may open as the hollow tube 30 is lifted due to weight of aggregate 44 on the top side of valve 54. Alternatively, valve 54 may be actuated by a hydraulic mechanism for example, or the hollow tube 30 may be raised and aggregate then added to flow through valve opening 53 by operation of valve 54. Alternatively, internal valve 38 may be opened during lifting or after lifting. Alternatively, if there is no valve 54, the sacrificial cap 64 will be released from the end of the head element 32, generally by force exerted by the weight of aggregate material 44 directed through the hollow tube 30 when the special head element 32 is raised from the bottom 81 of the formed pier cavity 102.

FIG. 9 illustrates the subsequent pushing downward of the hollow tube 30 and attachments and closing of the bottom valve 54 to compact the aggregate 44 in the cavity portion 85 thereby forcing the aggregate 44 and optional additives laterally as well as vertically downward, into the soil matrix 36. The predetermined movement distance for pushing downward is typically equal to the lifting distance 91 minus one foot, in order to produce a completed lift 72 thickness of one foot following the predetermined lifting distance 91 of hollow tube 30. The designed thickness of lift 72 may be different than one foot depending on the specific formed pier requirements and the engineering characteristics of the soil matrix 36 and aggregate 44. Compacting the aggregate material 44 released into the vacated cavity portion 85 in FIG. 7 to effect lateral movement of the aggregate material 44 horizontally as well as compaction vertically is important in the practice of the invention.

FIG. 10 illustrates the next or second lift formation effected by lifting of the hollow tube 30 and attachments another predetermined distance 91A, typically 24 to 48 inches to allow opening of the bottom valve 54 (in the event of utilization of the embodiment using valve 54) and passage or movement of aggregate 44 and optional additives into the portion of the cavity 85A that has been opened or exposed by raising tube 30.

Raising of the hollow tube in the range of two (2) to four (4) feet is typical followed by lowering (as described below) to form a pier lift 72, having a one (1) foot vertical dimension is typical for pier forming materials as described herein. The axial dimension of the lift 72 may thus be in the range of ¾ to ⅕ of the distance 91 the hollow tube 30 is raised. However, the embodiment depicted in FIGS. 23-26 constitutes an alternate compaction protocol.

FIG. 11 illustrates pushing down of the hollow tube 30 and attachments and closing of the bottom valve 54 to compact the aggregate 44 in the newly exposed cavity portion 85A of FIG. 10 and forcing of aggregate 44 and optional additives laterally into the soil matrix 36. The distance of pushing will be equal to the distance of lifting minus the designed lift thickness. When the sacrificial cap 64 method is utilized, the bottom opening 50 may remain open while compacting the aggregate 44.

Figure 21:
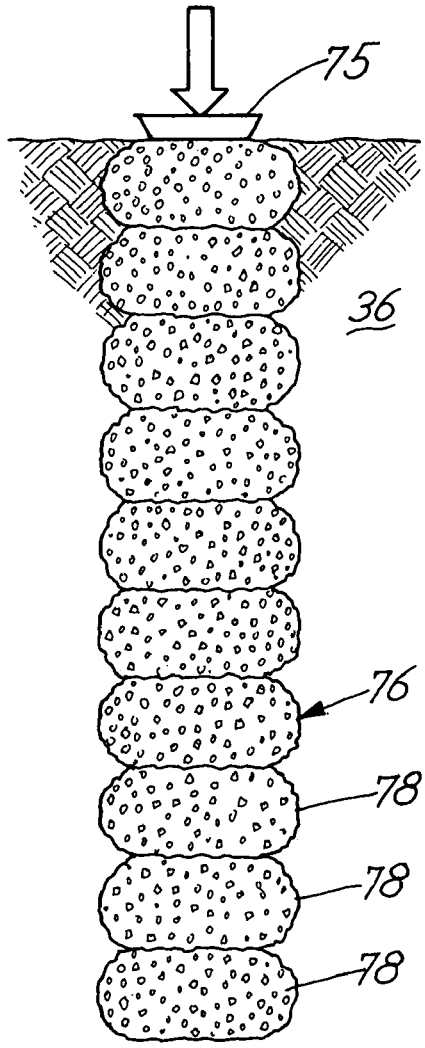
FIG. 21 is a cross sectional view of formed pier being preloaded or having an indicator modulus load test being performed on the completed pier.

FIG. 18 illustrates a partially formed pier by the process described wherein multiple lifts 72 have been formed sequentially by compaction and the hollow tube 30 is rising as aggregate 44 is filling cavity portion 85X. FIG. 19 illustrates a completely formed pier 76 by the process described. FIG. 20 illustrates a formed pier 76 with uplift anchor 68, 70 or tell-tale installed. FIG. 21 illustrates an optional preloading step on a formed pier 76 by placement of a weight 75, for example, on the formed pier and an optional indicator modulus test being performed on the formed pier 76 comprised of multiple compacted lifts 78.

Figure 23:
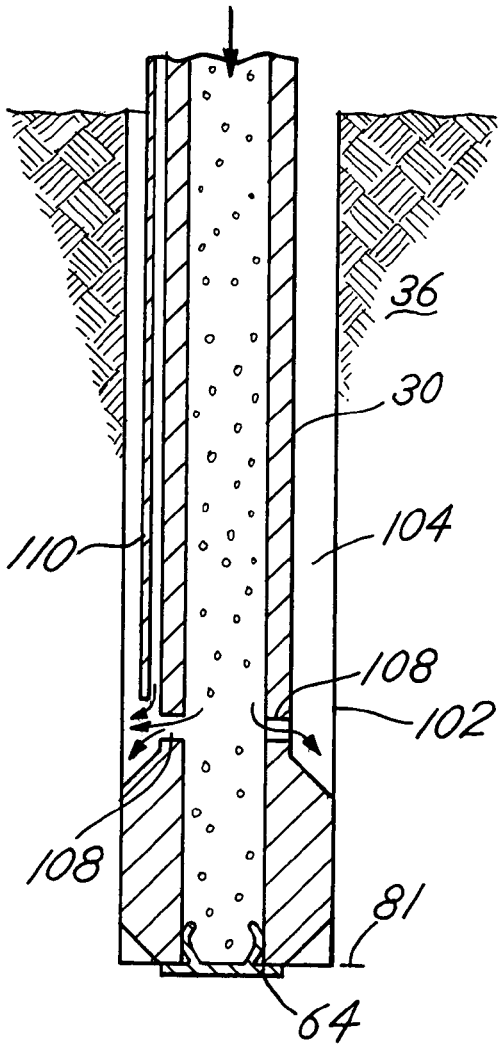
FIG. 23 is a schematic, cross sectional view of a method of use of the apparatus of the invention to form a single lift pier or a pier wherein one or more lifts are formed subsequent to raising the apparatus an extended distance from the bottom of a cavity formed by the apparatus initially in a soil matrix.

FIGS. 23 through 26 illustrate an alternative protocol for the formation of a pier using the described apparatus. The hollow tube 30 is initially forced or driven into a soil matrix 36 to a desired depth 100. The extreme bottom end of the head element 32 includes a valve mechanism 54, sacrificial cap 64 or the like. Forcing the hollow tube 30 vertically downward in the soil forms a cavity 102 (FIG. 23). Assuming the special bottom head element 32 is generally cylindrical, cavity 102 is generally cylindrical, and may or may not maintain the full diameter configuration associated with the shape and diameter of special bottom head element 32.

Figure 24:
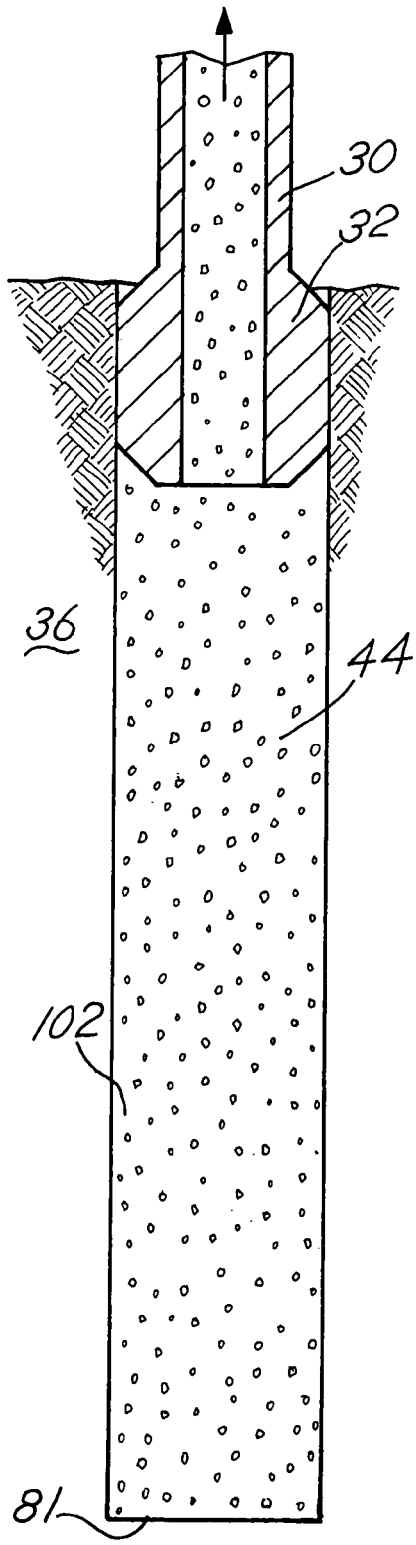
FIG. 24 is a schematic cross sectional view of continuation of the method illustrated by FIG. 23.
Figure 25:
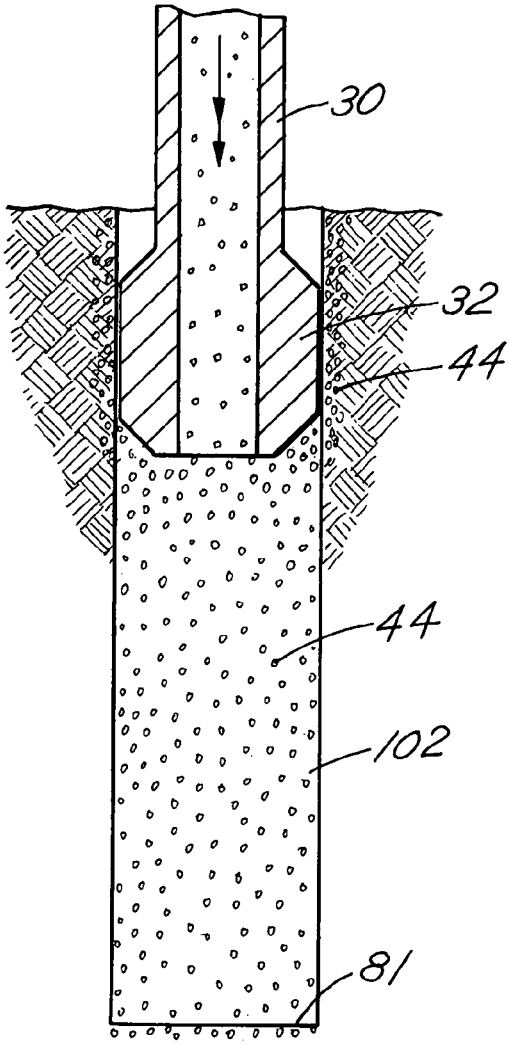
FIG. 25 is a schematic cross sectional view of further continuation of the step depicted in FIG. 24.

Upon reaching the desired penetration into the matrix soil 36 (FIG. 23), the hollow tube 30 is raised to the top of the formed cavity (FIG. 24). As it is raised, aggregate material 44 and optional additive materials are discharged below the bottom end of the special bottom head element 32.

Optionally, additive materials are discharged into the annular space 104 defined between the upper section 33 of hollow tube 30 and the interior walls of the formed cavity 102. Note the additive materials may flow through ancillary lateral passages 108 or supplemental conduits 110 in the hollow tube 30. As the hollow tube 30 is raised, the cavity 102 is filled. Also, additive materials in the annular space 104 may be forced outwardly into the soil matrix 36 by and due to the configuration of the special bottom head element 32 as it is raised.

The hollow tube 30 is thus typically raised substantially the full length of the initially formed cavity 102 and then, as depicted by FIG. 25, again forced downward causing the material in the cavity 102 to be compacted and to be forced laterally into the soil matrix 36 (FIG. 25). The extent of downward movement of the hollow tube 30 is dependent on various factors including the size and shape of the cavity 102, the composition and mix of aggregate materials and additives, the forces imparted on the hollow tube 30, and the characteristics of the soil matrix 36. Typically, the downward movement is continued until the lower end or bottom of the special bottom head element 32 is at or close to the bottom 81 of the previously formed cavity 102.

Figure 26:
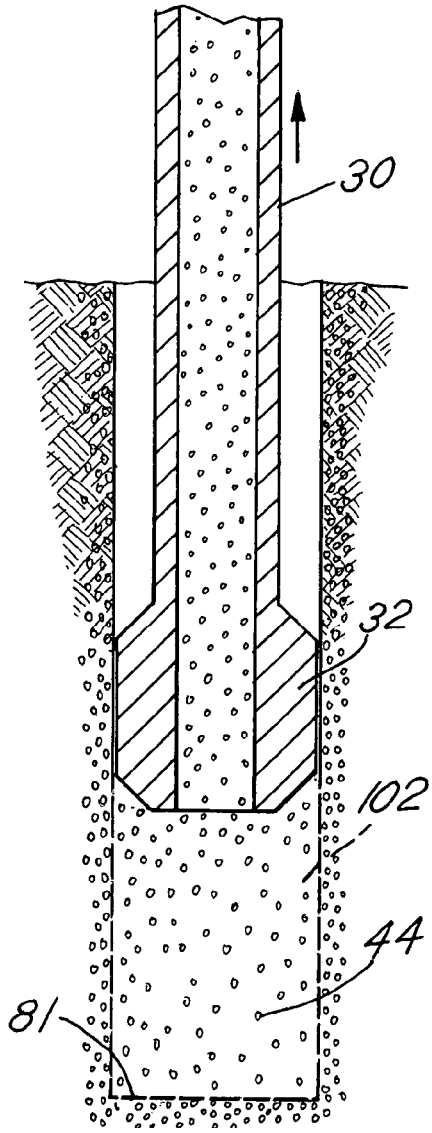
FIG. 26 is a schematic cross sectional view of the further continuation of the method of FIGS. 22-24.

After completion of the second downward movement, the hollow tube 30 is raised typically the full length of the cavity 102, again discharging aggregate and optionally additive materials during the raising, and again filling, the newly created cavity 102A (FIG. 26). The cycle of fully lowering and fully raising is completed at least two times and optionally three or more times, to force more aggregate 44 and optionally additive materials, laterally into the matrix soil 36. Further, the cycling may be adjusted in various patterns such as fully raising and lowering followed by fully raising and partially lowering, or partially raising and fully lowering, and combinations thereof.

Summary Considerations:

Water or grout or other liquid may be utilized to facilitate flow and feeding of aggregate material 44 through hollow tube 30. The water may be fed directly into the hollow tube 30 or through the hopper 34. It may be under pressure or a head may be provided by using the hopper 34 as a reservoir. The water, grout or other liquid thus enables efficient flow of aggregate, particularly in the small diameter hollow tube 30, i.e. 5 to 10 inches tube 30 diameter. Note typically the size of the tube 30 internal passage and/or discharge opening is at least 4.0 times the maximum aggregate size for all the described embodiments. With each lift 72 being about 12 inches in vertical height and the internal diameter of tube 30 being about 6 to 10 inches, use of water as a lubricant is especially desirable.

It is noted that the diameter of the cavity 102 formed in the matrix soil 36 is relatively less than many alternative pier forming techniques. The method of utilizing a relatively small diameter cavity 102 or a small dimension opening into the soil matrix 36, however, enables forcing or driving a tube 30 to a significant depth and subsequent formation of a pier having horizontal dimensions adequately greater than the external dimensions of the tube 30. Utilization of aggregate 44 with or without additives including fluid materials to form one or more lifts by compaction and horizontal displacement is thus enabled by the hollow tube 30 and special bottom head element 32 as described. Lifts 72 are compacted vertically and aggregate 44 forced transaxially with the result of a highly coherent pier construction.

Figure 22:
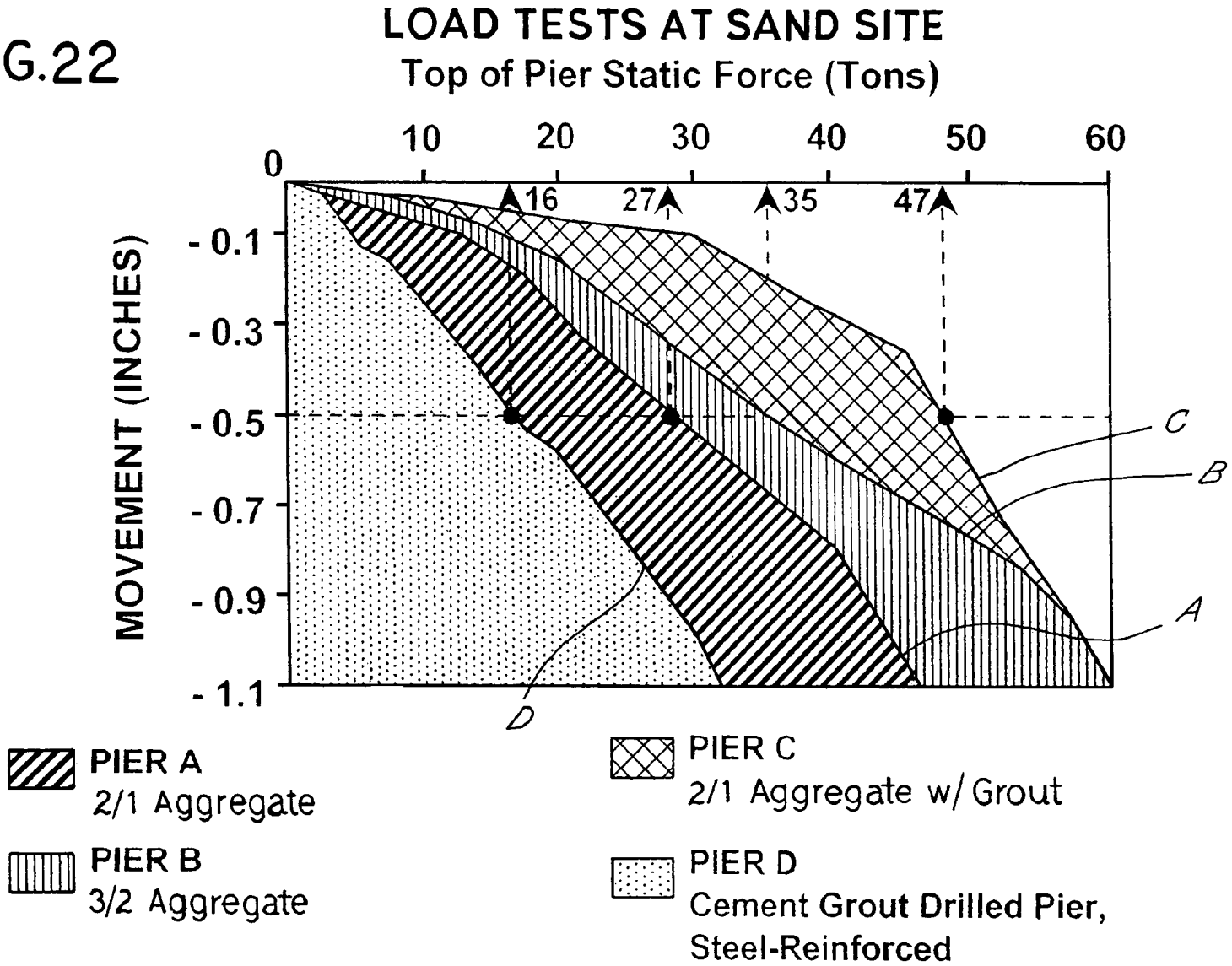
FIG. 22 is a graph illustrating comparative load test plots of the present invention compared with a drilled concrete pile in the same soil matrix formation.

Test Results:

FIG. 22 illustrates the results of testing of piers of the present invention as contrasted with a drilled concrete pier. The graph illustrates the movements of three piers constructed in accordance with the invention (curves A, B, C) with a prior art drilled concrete pier (curve D), as the piers are loaded with increasing loads to maximum loads and then decreasing loads to zero load. The tests were conducted using the following test conditions and using a steel-reinforced, drilled concrete pier as the control test pier.

A hole or cavity of approximately 8-inches in diameter was drilled to a depth of 20 feet and filled with concrete to form a drilled concrete pier (test D). A steel reinforcing bar was placed in the center of the drilled concrete pier to provide structural integrity. A cardboard cylindrical form 12 inches in diameter was placed in the upper portion of the pier to facilitate subsequent compressive load testing. The matrix soil for all four tests was a fine to medium sand of medium density with standard Penetration Blow Counts (SPT's) ranging from 3 to 17 blows per foot. Groundwater was located at a depth of approximately 10 feet below the ground surface.

The aggregate piers of the invention, reported as in tests A, B, and C, were made with a hollow tube 30, six (6) inches in external diameter and with a special bottom head element 32 with an external diameter of 10 inches. Tests A and B utilized aggregate only. Test C utilized aggregate and cementatious grout. Test A utilized predetermined lifting movements of two feet and predetermined downward pushing movements of one foot resulting in a plurality of one foot lifts. Test B utilized predetermined upward movements of three feet and predetermined downward pushing movements of two feet, again resulting in one foot lifts. Test C utilized predetermined upward movements of two feet and predetermined downward pushing movements of one foot, and included addition of cementatious grout.

Analyses of the data can be related to stiffness or modulus of the piers constructed. At a deflection of 0.5 inches, test A corresponded to a load of 27 tons, test B corresponded to a load of 35 tons, test C corresponded to a load of 47 tons and test D corresponded to a load of 16 tons. Thus at this amount of deflection (0.5 inches) and using test B as the standard test and basis for comparison, ratios of relative stiffness for test B is 1.0, test A is 0.77, Test C is 1.34, and Test D is 0.46. The standard, Test B, is 2.19 times stiffer than the control test pier, Test D. The standard Test B is 1.30 times stiffer than Test A, whereas the Test C with grout additive is 2.94 times stiffer than the prior art concrete pier (Test D). This illustrates that the modulus of the piers formed by the invention are substantially superior to the modulus of the drilled, steel-reinforced concrete pier (Test D). These tests also illustrate that the process of three feet lifting movement with two feet downward pushing movement was superior to the process of two feet lifting movement and one foot downward pushing movement. The tests also illustrate that use of cementatious grout additive substantially improved the stiffness of the formed pier for deflections less than about 0.75 inches, but did not substantially improve the stiffness of the formed pier compared with Test B for deflections greater than about 0.9 inches.

In the preferred embodiment, because the bottom head element 32 of the hollow tube or hollow shaft 30 has a greater cross sectional area, various advantages result. First the configuration of the apparatus, when using a bottom valve mechanism 54, reduces the chance that aggregate material will become clogged in the apparatus during the formation of the cavity 102 in the soil matrix 36 as well as when the hollow tube 30 is withdrawn partially from the soil matrix 36 to expose or form a cavity 85 within the soil matrix 36. Further, the configuration allows additional energy from static force vectors and dynamic force vectors to be imparted through the bottom head element 32 of the apparatus and impinge upon aggregate 44 in the cavity 70. Another advantage is that the friction of the hollow tube 30 on the side of the formed cavity 102 in the ground is reduced due to the effective diameter of the hollow tube 30 being less than the effective diameter of the bottom head element 32. That is, the cross section area of the remainder of the hollow tube 30 is reduced. This permits quicker pushing into the soil and allows pushing through formations that might be considered to be more firm or rigid. The larger cross sectional area head element 32 also enhances the ability to provide a cavity section 102 sized for receipt of aggregate 44 which has a larger volume than would be associated with the remainder of the hollow shaft 30 thus providing for additional material for receipt of both longitudinal (or axial) and transverse (or transaxial) forces when forming the lift 72. The reduced friction of the hollow tube 30 on the side of the formed cavity 102 in the soil 36 also provides the advantage of more easily raising the hollow tube 30 during pier formation.

In the process of the invention, the lowest lift 72 may be a larger effective diameter and have a different amount of aggregate provided therein. Thus the lower lift 72 or lowest lift in the pier 76 may be configured to have a larger transverse cross section as well as a greater depth when forming a base for the pier 76. In other words, by way of example the lowest portion or lowest lift 72 may be created by lifting of the hollow shaft 30 three feet and then reducing the height of the lift 72 to one foot, whereas subsequent lifts 72 may be created by raising the hollow shaft 30 two feet and reducing the thickness of the lift 72 to one foot.

The completed pier 76 may, as mentioned heretofore, be preloaded after it has been formed by applying a static load or a dynamic load 75 at the top of the pier 76 for a set period of time (see FIG. 21). Thus a load 75 may be applied to the top of the pier 76 for a period of time from 30 seconds to 15 minutes, or longer. This application of force may also provide a "modulus indicator test" inasmuch as a static load 75 applied to the top of the pier 76 can be accompanied by measurement of the deflection accruing under the static load 75. The modulus indicator test may be incorporated into the preload of each pier to accomplish two purposes with one activity; namely, (1) applying a preload; and (2) performing a modulus indicator test.

The aggregate material 44 which is utilized in the making of the pier 76 may be varied. That is, clean aggregate stone may be placed into a cavity 85. Such stone may have a nominal size of 40 mm diameter with fewer than 5% having a nominal diameter of less than 2 mm. Subsequently a grout may be introduced into the formed material as described above. The grout may be introduced simultaneous with the introduction of the aggregate 44 or prior or subsequent thereto.

When a vibration frequency is utilized to impart the dynamic force, the vibration frequency of the force imparted upon the hollow shaft or hollow tube 30 is preferably in a range between 300 and 3000 cycles per minute. The ratio of the various diameters of the hollow tube or shaft 30 to the head element 32 is typically in the range of 0.92 to 0.50. As previously mentioned, the angle of the bottom bevel may be between 30° and 60° relative to a longitudinal axis 35.

As a further feature of the invention, the method for forming a pier may be performed by inserting the hollow tube 30 with the special bottom head element 32 to the total depth 81 of the intended pier. Subsequently, the hollow tube 30 and special bottom head element 32 will be raised the full length of the intended pier in a continuous motion as aggregate and/or grout or other liquid are being injected into the cavity as the hollow tube 30 and special bottom head element 32 are lifted. Subsequently, upon reaching the top of the intended pier, the hollow tube 30 and special bottom head element 32 can again be statically pushed and optionally augmented by vertically vibrating and/or ramming dynamic force mechanism downward toward or to the bottom of the pier in formation. The aggregate 44 and/or grout or other material filling the cavity as previously discharged will be moved transaxially into the soil matrix as it is displaced by the downwardly moving hollow tube 30 and head element 32. The process may then be repeated with the hollow tube 30 and head element 32 raised either to the remaining length or depth of the intended pier or a lesser length in each instance with aggregate and/or liquid material filling in the newly created cavity as the hollow tube 30 is lifted. In this manner, the material forming the pier may comprise one lift or a series of lifts with extra aggregate material and optional grout and/or other additives transferred laterally to the sides of the hollow cavity into the soil matrix.

It is noted that the mechanism for implementing the aforesaid procedures and methods may operate in an accelerated manner. Driving the hollow tube 30 and head element 32 downwardly may be effected rather quickly, for example, in a matter of two minutes or less. Raising the hollow tube 30 and head element 32 incrementally a partial or full distance within the formed cavity may take even less time, depending upon the distance of the lifting movement and rate of lifting. Thus, the pier is formed from the soil matrix 36 within a few minutes. The rate of production associated with the methodology and the apparatus of the invention is therefore significantly faster.

Various modifications and alterations may thus be made to the methodology as well as the apparatus to be within the scope of the invention. Thus, it is possible to vary the construction and method of operation of the invention without departing form the spirit and scope thereof. Alternative hollow tube configurations, sizes, cross sectional profiles and lengths of tube may be utilized. The special head element 32 may be varied in its configuration and use. The bottom valve 54 may be varied in its configuration and use, or may be eliminated by use of a sacrificial cap. The leading end of the bottom head element 32 may have any suitable shape. For example, it may be pointed, cone shaped, blunt, angled, screw shaped, or any shape that will facilitate penetration of a matrix soil and compaction of aggregate material. The enlarged or bulbous head element 32 may be utilized in combination with one or more increased external diameter sections of the hollow tube 30 having various shapes or configurations. Therefore the invention is to be limited only by the following claims and equivalents thereof.

What is claimed is:

1. Apparatus for construction of a multiple lift, compacted pier in a soil matrix comprising, in combination:

an elongate hollow tube having a longitudinal axis, a top material entrance and, an open bottom material discharge end and a first outer surface diameter, and a unitary, shaped bottom head element at the open discharge end having a second outside surface diameter greater than the first surface outside diameter and configured to provide a combination of axial and transaxial stress components upon lowering the hollow tube, said head element comprising a unitary attachment of the hollow tube; said head element including a leading bottom end including a generally frustoconical configuration between the head element outside surface and a bottom discharge opening in the leading bottom end and a trailing end including a generally frustoconical configuration; and a head element cap covering the bottom discharge opening;

said bottom head element with said cap and said hollow tube being shaped for insertion in a soil matrix to effect displacement of the soil as the hollow tube with the bottom head element and said cap are lowered into the soil matrix to form a cavity in the soil matrix, said cap being at least partially removable from the bottom discharge opening as the hollow tube is subsequently raised from said formed cavity to allow material flow through the bottom discharge opening into the portion of the cavity vacated by the hollow tube and bottom head element, said bottom head element having a cross sectional shape and size greater than the cross sectional shape and size of the hollow tube to reduce frictional forces on the hollow tube when penetrating into and withdrawing from the soil matrix.

2. The apparatus of claim 1 further including a fluid feed mechanism for directing a fluid material into the hollow tube and a solid material feed mechanism for feeding aggregate material into the hollow tube entrance end.

3. The apparatus of claim 1 including aggregate in said hollow tube;

said hollow tube having a generally circular internal cross section and further including an aggregate feed mechanism connected to the top material entrance end for feeding items of aggregate material into said hollow tube wherein the minimum size of the internal diameter of the hollow tube is at least about 4.0 times the maximum size dimension of the largest item of aggregate material in said hollow tube.

4. The apparatus of claim 1 further including at least one auxiliary feed tube connected to the hollow tube through openings in the hollow tube end for feeding fluid material into the hollow tube.

5. The apparatus of claim 1 further including a hopper for feeding material into the hollow tube and at least one auxiliary feed tube connected to said hopper for feeding liquid material into the hollow tube.

6. The apparatus of claim 1 or further including passageway openings in the hollow tube above the bottom head element for fluid materials within the hollow tube to flow out of the hollow tube above the bottom head element and outside of the hollow tube into an annulus formed between the hollow tube and the soil matrix.

7. The apparatus of claim 1 further including a hopper feed mechanism connected to the top material entrance end of the hollow tube.

8. The apparatus of claim 1 further including a hopper and least one isolation damper connecting the hopper to the hollow tube.

9. The apparatus of claim 1 further including a force mechanism connected to the hollow tube for providing a downwardly directing force on said hollow tube.

10. The apparatus of claim 1 further including a force mechanism connected to the hollow tube for providing a downwardly directed static axial force.

11. The apparatus of claim 1 including a force mechanism for providing a tree on the hollow tube selected front the group consisting of a vertically reciprocating force, a vertically vibrating dynamic axial force, and combinations thereof.

12. The apparatus of claim 1 wherein said cap comprises a sacrificial cap.

13. The apparatus of claim 12 wherein the sacrificial cap comprises a transaxial plate member for retention at the bottom of a formed pier member.

14. The apparatus of claim 12 wherein the cap further comprises at least one axial rod in combination with said plate member.

15. The apparatus of claim 14 wherein at least one said rod extends axially from the bottom of a formed pier to above ground surface level.

16. The apparatus of claim 1 wherein the head element and hollow tube each share a uniform cylindrical cross sectional profile.

17. The apparatus of claim 1 wherein said cap comprises a mechanism for opening and closing said bottom discharge opening to allow material flow from the bottom discharge opening upon opening and to block material flow from the bottom discharge opening upon closing.

18. The apparatus of claim 1 wherein said leading bottom end provides an energy imparting surface to compact aggregate in said cavity.

* * * * *